United States Patent [19]

Fejdasz et al.

[11] Patent Number: 4,932,665

[45] Date of Patent: Jun. 12, 1990

[54] METHOD OF PLAYING A BOARD GAME SIMULATING THE WILD WEST

[76] Inventors: Joseph F. Fejdasz, USSAH Box 279, Washington, D.C. 20317; Keith Simerson, 4020 Gravenstein Hwy. So., Sebastopol, Calif. 95472

[21] Appl. No.: 248,193

[22] Filed: Sep. 23, 1988

[51] Int. Cl.[5] ..... A63F 3/00

[52] U.S. Cl. ..... 273/249; 278/256; 278/142 E; 278/146

[58] Field of Search ..... 273/246, 196, 142 E, 273/251–254, 256, 249, 248

[56] References Cited

U.S. PATENT DOCUMENTS

| | | | |
|---|---|---|---|
| 1,652,851 | 12/1927 | Bendtin | 273/251 |
| 2,128,608 | 8/1938 | Goertemiller | 273/251 |
| 3,693,977 | 9/1972 | de Keller | 273/248 |
| 3,963,243 | 6/1976 | Contento | 273/146 |
| 4,273,337 | 6/1981 | Carrera et al. | 273/243 |
| 4,566,697 | 1/1986 | Vickers | 273/256 |

FOREIGN PATENT DOCUMENTS

| | | | |
|---|---|---|---|
| 15223 | of 1907 | United Kingdom | 273/251 |
| 1266949 | 3/1972 | United Kingdom | 273/251 |
| 1386097 | 3/1975 | United Kingdom | 273/252 |

*Primary Examiner*—Benjamin Layno

*Attorney, Agent, or Firm*—Richard C. Litman

[57] ABSTRACT

An old west mining town is depicted on a map on a game board with two segmented paths, a right path and a left path, each having a plurality of sequential spaces. Tokens are selected by players. The tokens are shaped to represent typical classical old west characters, both male and female. A first die having "right", "left" and "choice" directions in its faces determines which path the tokens are to follow. A second conventional die determines the number of spaces along the paths the tokens are to move. Bonus cards, stock cards and penalty cards are directed to be taken by the individual players as indicated by indicia on the spaces landed on. Payments are made and received by player to and from the bank. When a player's token lands on a space having instructions representing a players death, that player is automatically taken out of the game, whereby the players token is removed from the board and the player's acquired stock cards, bonus cards and money are returned to the bank. The winner acquires the highest value of cash stocks and bonus cards.

2 Claims, 12 Drawing Sheets

"C"
13
LOSE $1000 ON SLOTS
26
WIN $5000 ON CRAPS
22
WIN $500 ON CRAPS
LOSE (1) TURN
21
13
UNION ST.
3
20
FINED $100 FOR FIGHTING OR LOSE (2) TURNS
WIN $500 ON ROULETTE
20
3
WIN $1000 ON CRAPS
25
ST.
GO BACK (3) SPACES
11
B 2
PAY LAUNDRY BILL $50
18
7
52
21
22
PENALTY CARDS
30
GO BACK (5) SPACES
29
ADVANCE (5) SPACES
28
33
5
9

C I
27
9
LOOSE $5000 ON CAMEL RACE
24
28
PAY $500 FINE OR TAKE PENALTY CARD
23
16
11
5
WIN $5000 AT '21'
SHOOTOUT GET KILLED
21
DOUBLE JEOPARDY LOSE (1) TURN
GO TO JAIL LOSE (2) TURNS
3
5
WIN $1000 AT '21'
34
9
18
50
BONUS CARDS

C2

C3

METHOD OF PLAYING A BOARD GAME SIMULATING THE WILD WEST

SUMMARY OF THE INVENTION

There are many board games that require movement of tokens representing different players for depicting competitiveness in life situations. The well-known game sold under the trademark "MONOPOLY" is typical of such games. They are largely games of chance requiring boards with segmented paths with sequential spaces. Various actions are taken by the player represented by a token landing on the various spaces. These actions may include drawing cards which give instructions to move elsewhere, or acquire or spend money to other players or the bank. In MONOPOLY buying, renting and otherwise financially "wheeling and dealing" may take place when a player lands on a particular space. Finances is the aspect of life situations that "MONOPOLY" deals with.

The present game deals with the life of an inhabitant in the typical old west mining town. The players are represented by tokens moving through the town and its fortunes and hazards befall the players on their trek.

It is an object of this game to depict circumstances and life in an old western town.

It is a further object of this game to present paths through the town where any of the dramatic events of life there might befall the players.

It is a further object to stay alive in this town.

It is a further object to acquire money and property in this walk through the town.

PREVIOUS PATENTS

Typical board games are below:

The U.S. Utility Patent No. 3,850,433 issued to J. M. Purlia is a board game drawn to the situations of players and their business transactions.

The U.S. Utility Patent No. 3,565,437 issued to T. N. Mitchell is a board game drawn to various aspects of running a discount store.

The U.S. Utility Patent No. 3,901,513 issued to R. H. Spohn is drawn to the problems of arranging new items on a newspaper's front page.

The U.S. Utility Patent No. 4,136,881 issued to R. Anspach is drawn to business development or real estate trading.

The U.S. Utility Patent No. 4,283,059 issued to W. A. Beeder is drawn to building of airline companies.

The U.S. Utility Patent No. 4,497,490 issued to T. J. Rogers, Jr. is drawn to players competitively challenging each other as dictated by a player's position on the board.

DETAILED DESCRIPTION

Figure 1:
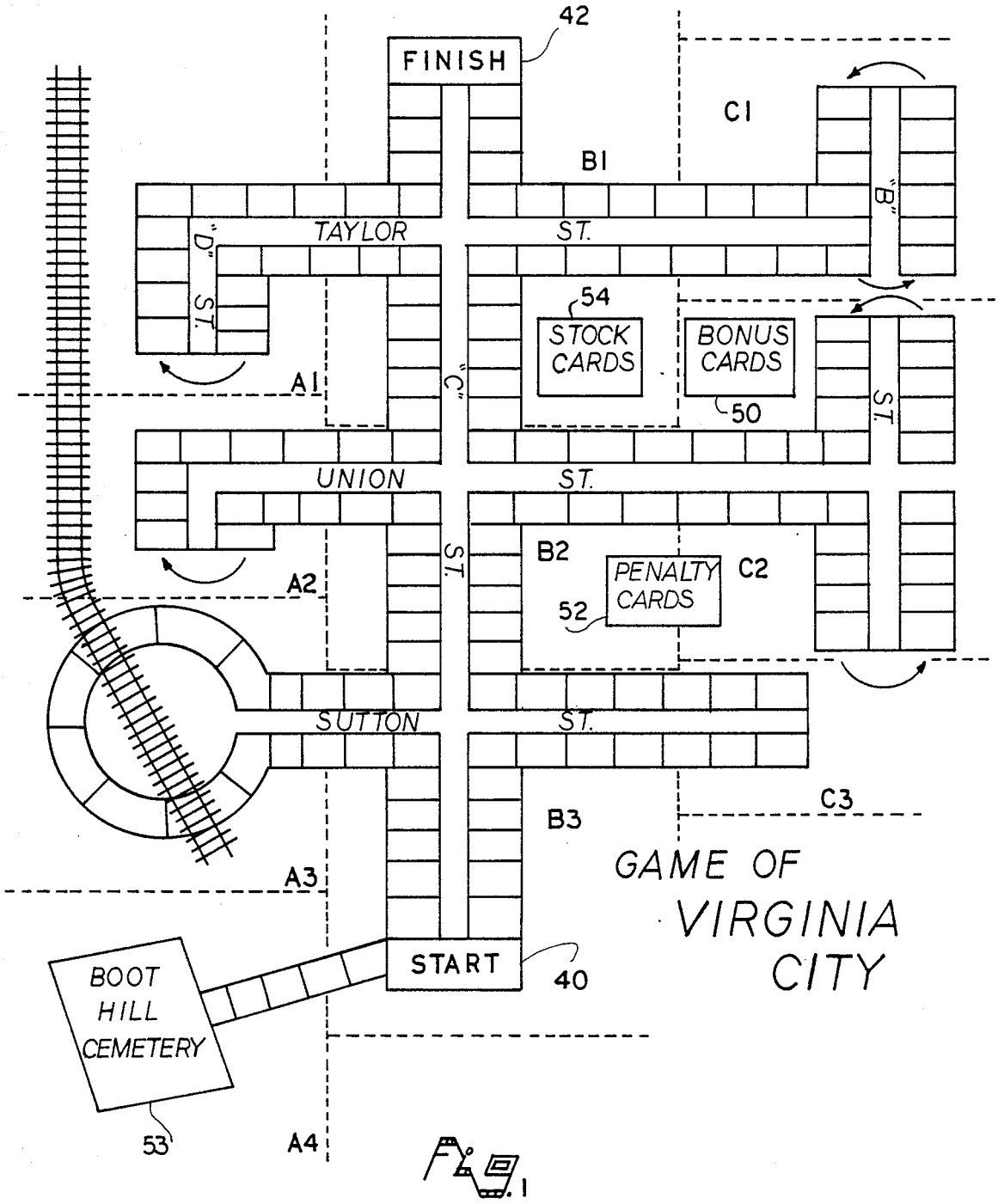
FIG. 1 is a complete view of the game board map with section lines depicting areas of expanded views with legends in the spaces of the paths of the game. The spaces are not drawn to scale in proportionate numbers.
Figure 6:
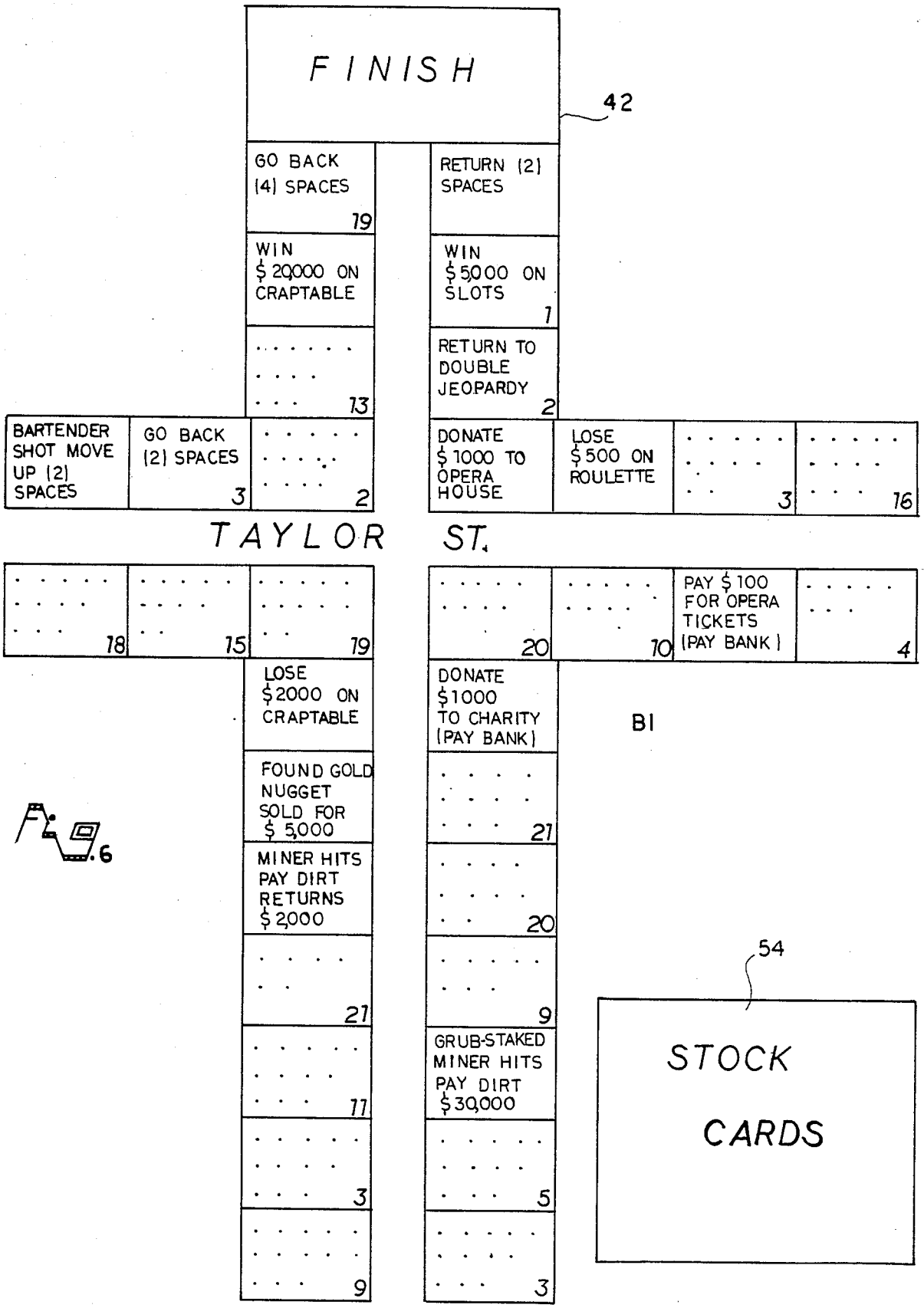
Figure 7:
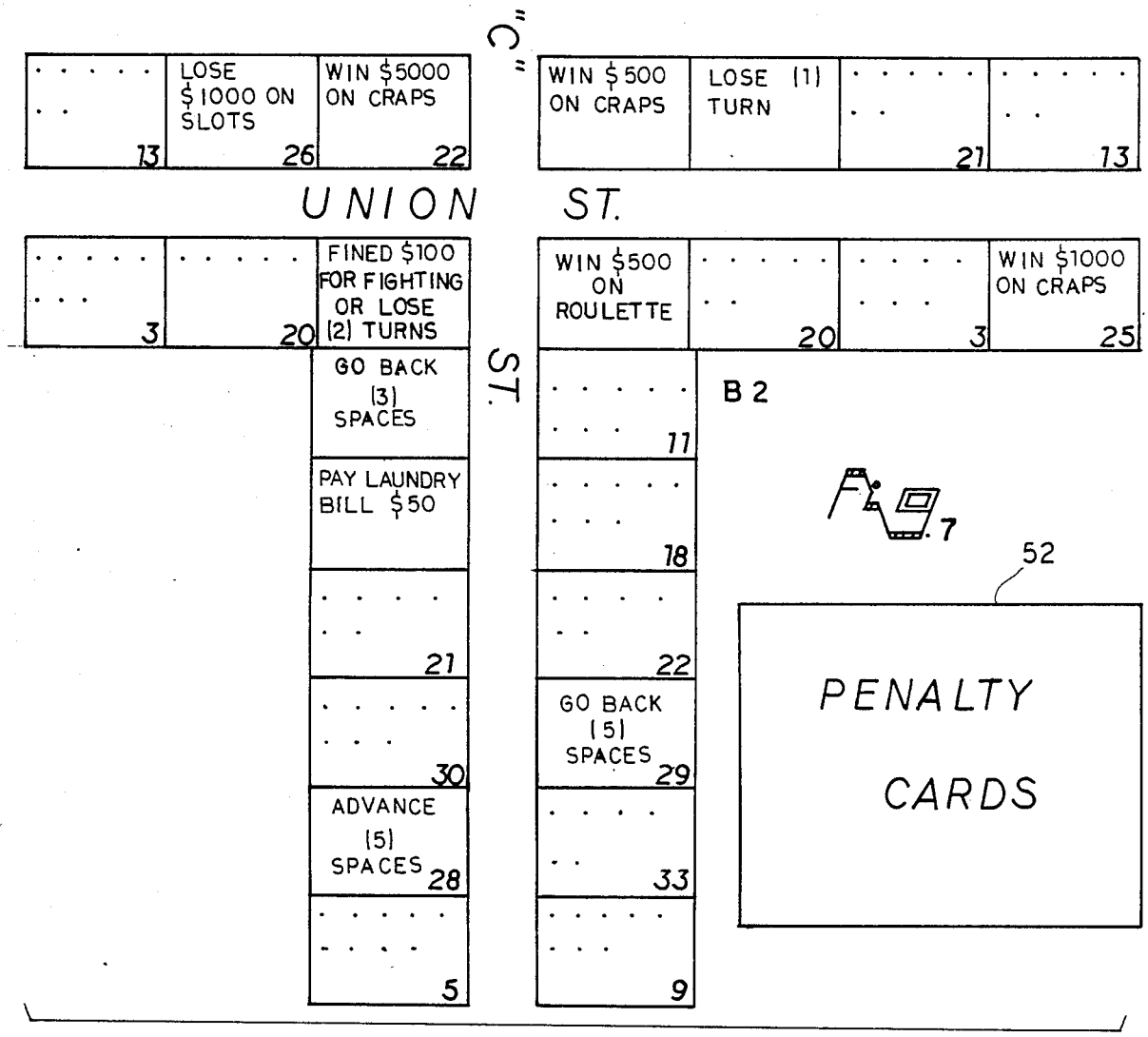
Figure 8:
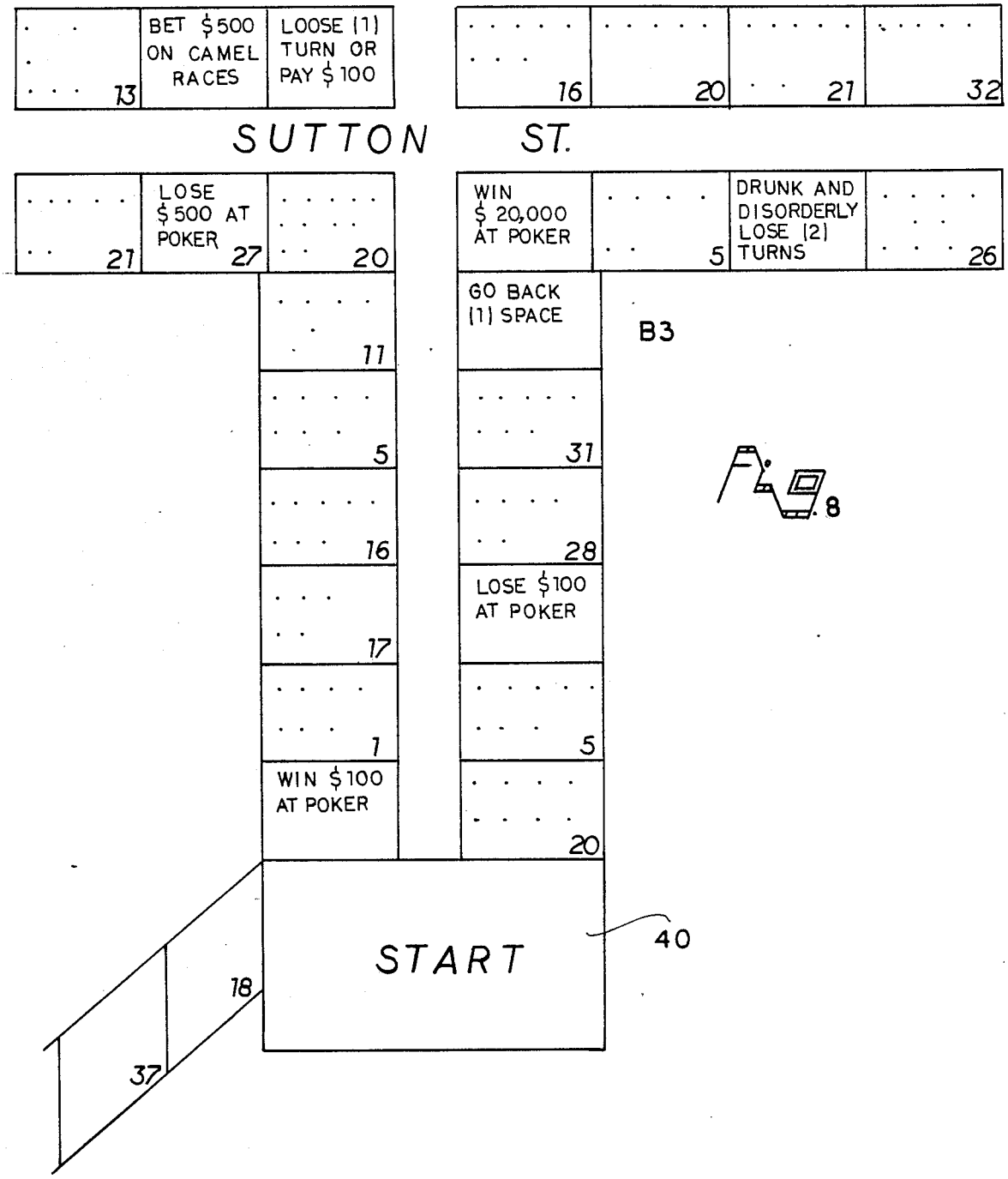
Figure 9:
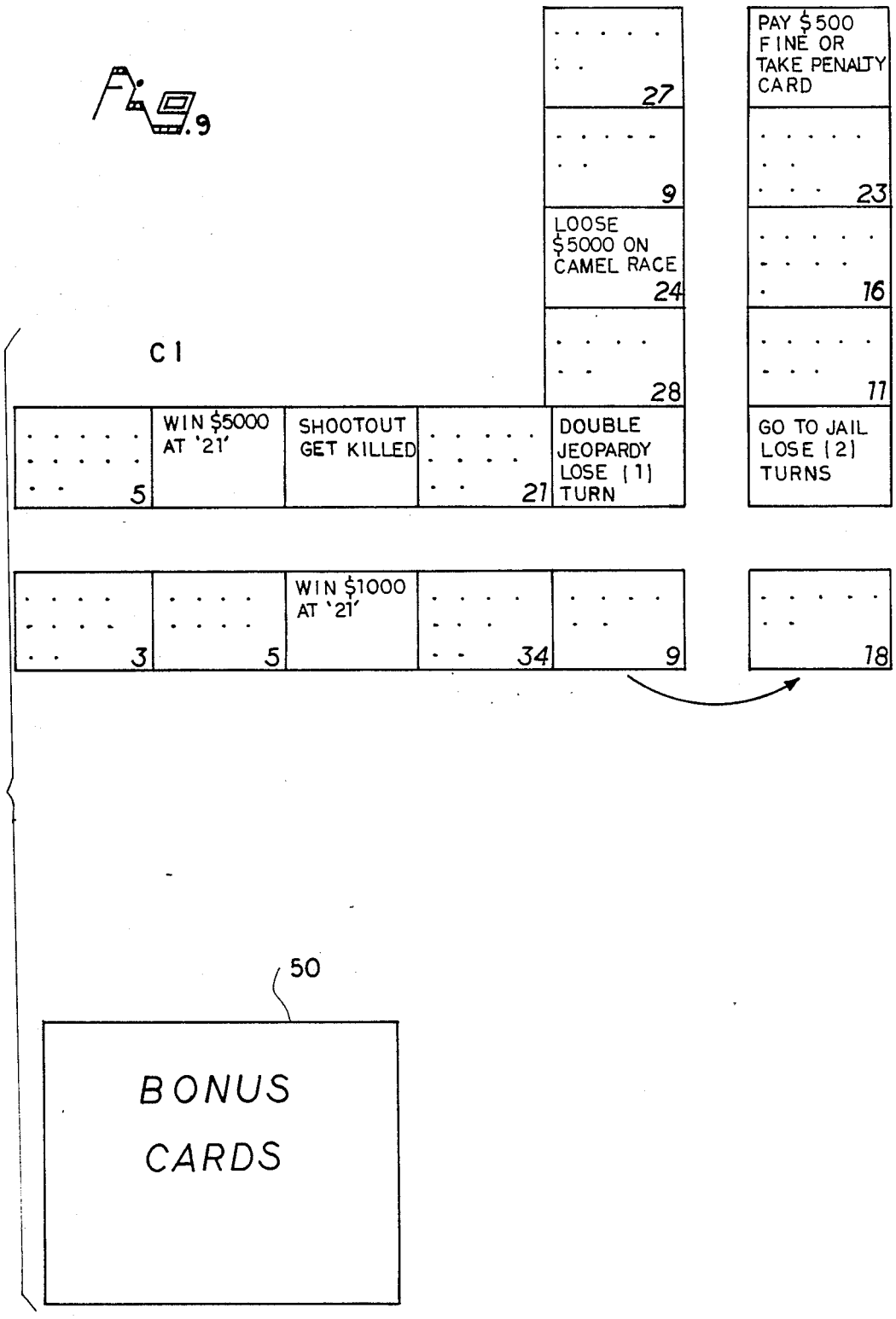
Figure 10:
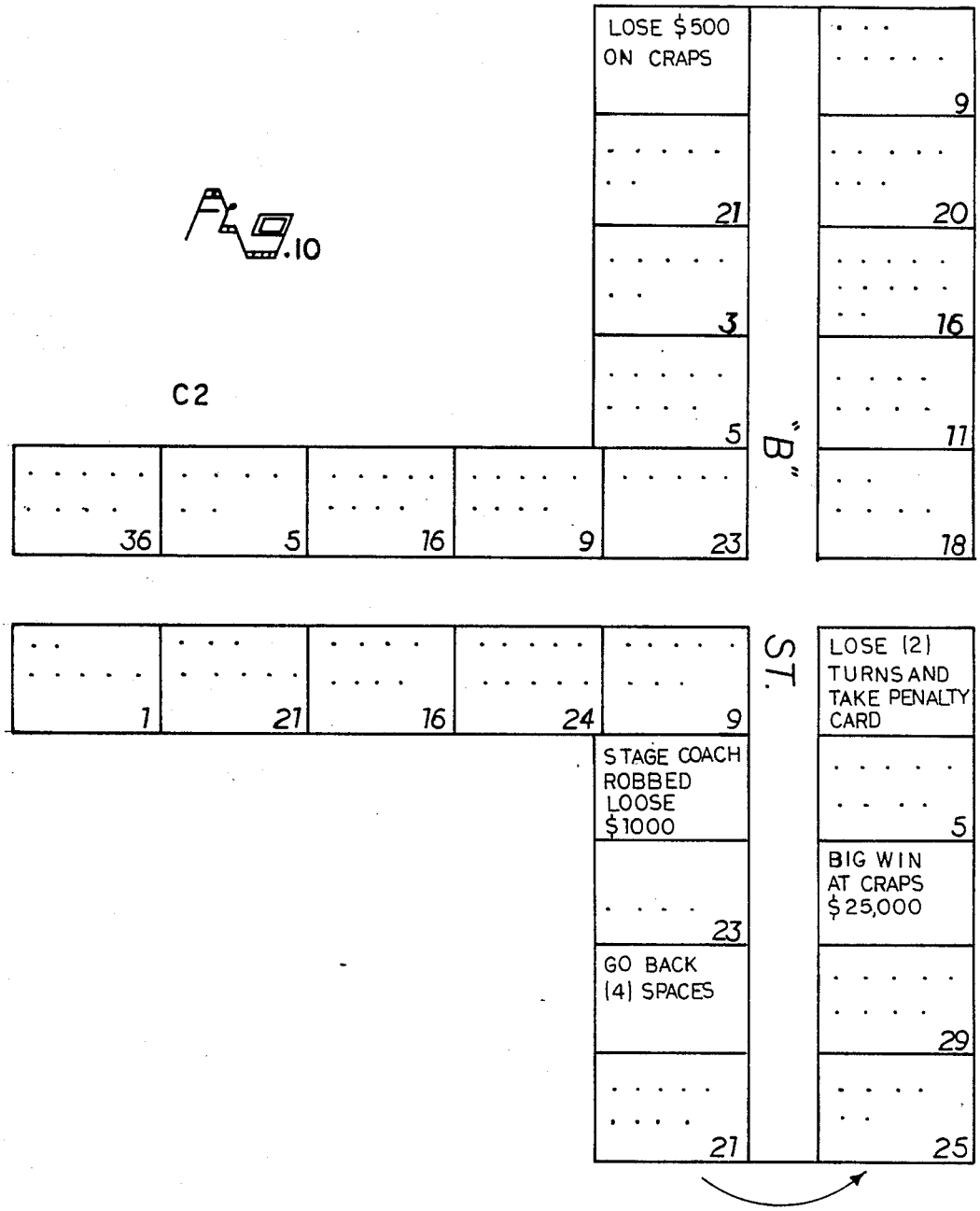
Figure 11:
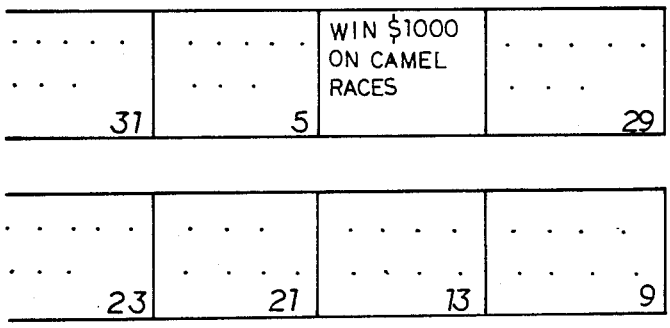

In FIG. 1 is depicted a small old western mining town that has been divided up into smaller areas labeled A-1, A-2, A-3, A-4, B-1, B-2, B-3, C-1, C-2, and C-3. Each of these areas have been magnified in FIGS. 2–11. It will be noted that in these magnified versions various legends are discernible in the space of the segmented paths through the town. Repeated legends are described by like numerals in the corner of the space. In area B-3, FIG. 8, there is a starting space 40 and in area B-1, FIG. 6, there is a finishing space 42. There are a right-hand side at the start and a left-hand side so that there are two independent paths throughout the map initiated at this start position, to the right and to the left.

Figure 13:
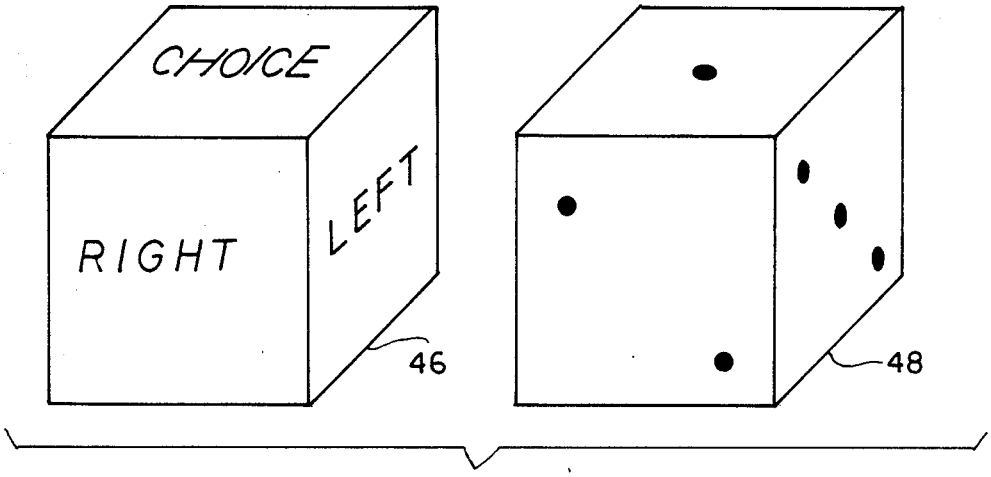
FIG. 13 is a perspective view of the dice.
Figure 14:
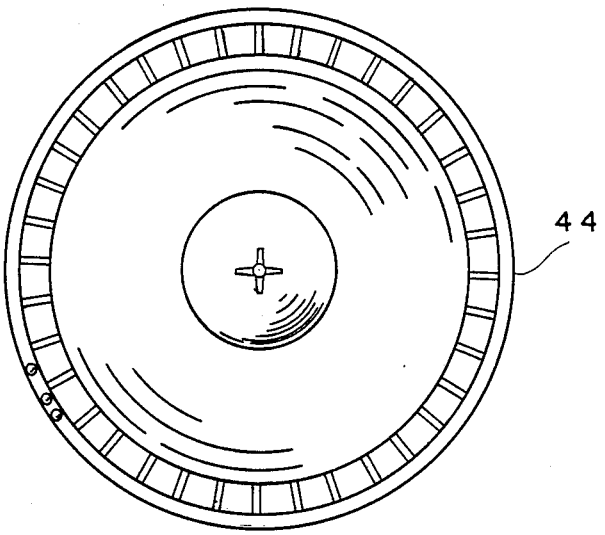
FIG. 14 is a roulette wheel.

To start the game, one player will be designated as banker. Each player will be given $10,000.00 by the banker before activity begins. All players up to eight in number will take turns to spin the pointer wheel 44 of FIG. 14 to get a starting sequence of players. Players having conflicting numbers from their individual spins will spin again until all players have a different starting order. The player with the highest number then rolls both dice 46 and 48 of FIG. 13. The dice 46 that directs "right", "left", or "choice" will tell the player which side from the starting space and on the street he will count off the sequential spaces on the street until he travels the number directed by the other conventional dice 48. He will either start on the right or left side or make his own choice.

Figure 12:
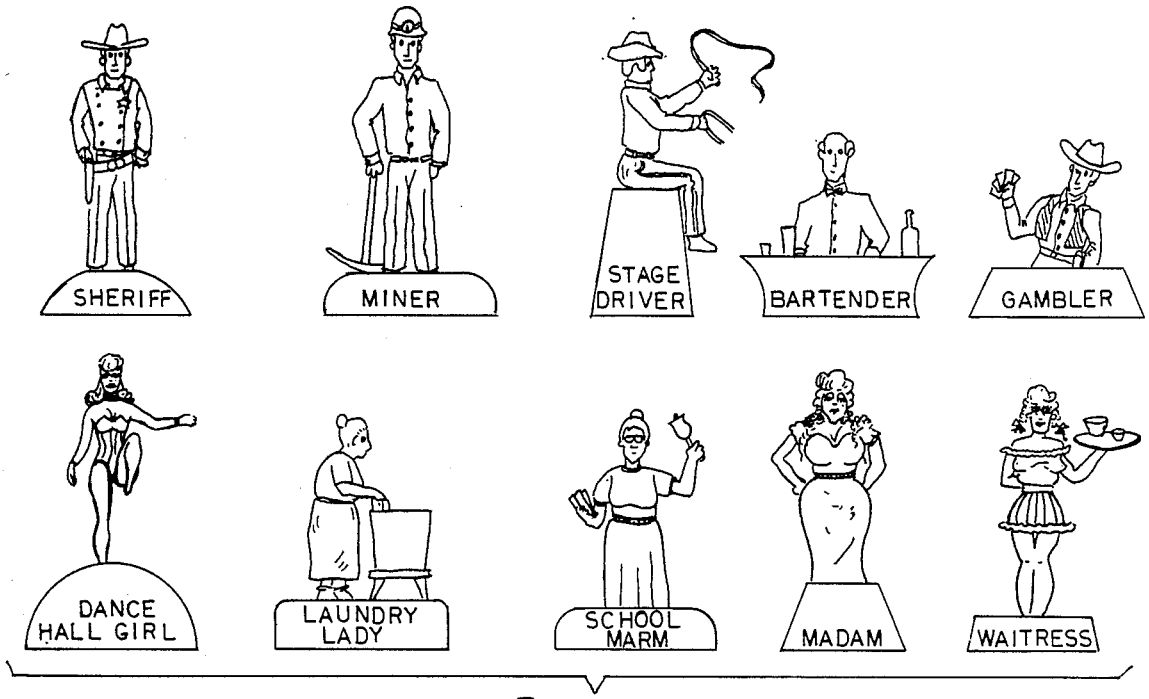
FIG. 12 depicts the tokens representing the players with classical western characters.

Prior to rolling the dice each player will select one of the classical old western characters (see FIG. 12) to represent himself or herself with the corresponding token. In turn every player will roll both dice (see FIG. 13) and initiate his trek through the streets of the town Virginia City. Thereafter for each player's turn only the conventional dice will be thrown moving his or her token the number of sequential spaces shown on the dice.

If a player lands on the space marked "Take a Bonus Card", that player takes the top card from the Bonus card pile 50 and retains this card until the end of the game. Landing on the spaces marked "lose a $100 at poker", "grubstake miner for $500," "pay $50 fine for fighting," "lose $5000 at Black-Jack", etc. results in paying the banker the various amounts by the unfortunate player that lands on these spaces. Oppositely, landing on spaces marked "win $5,000 at poker," "win $1,000 on slots," "win $1,000 on camel races," etc. the fortunate player collects these amounts from the banker. When a player lands on the square marked "pick penalty card" the player takes the top card from the penalty card pile and pays the penalty to the banker; then he returns this card to the bottom of the penalty card pile. If a player lands on the space marked "visit Boot Hill" the player returns the respresentative token to Boot Hill cemetery 53 and starts back to the starting point and up the street and returns to the street space where he or she had been. When a player lands on the space marked "pick stock card" this player takes the top card from the stock card pile 54 and retains the card until the end of the game. Unlucky players landing on the space marked "horse thief-get hung" or "shoot out-get killed" are out of the game and their player stocks and money are returned to the bank.

Figure 2:
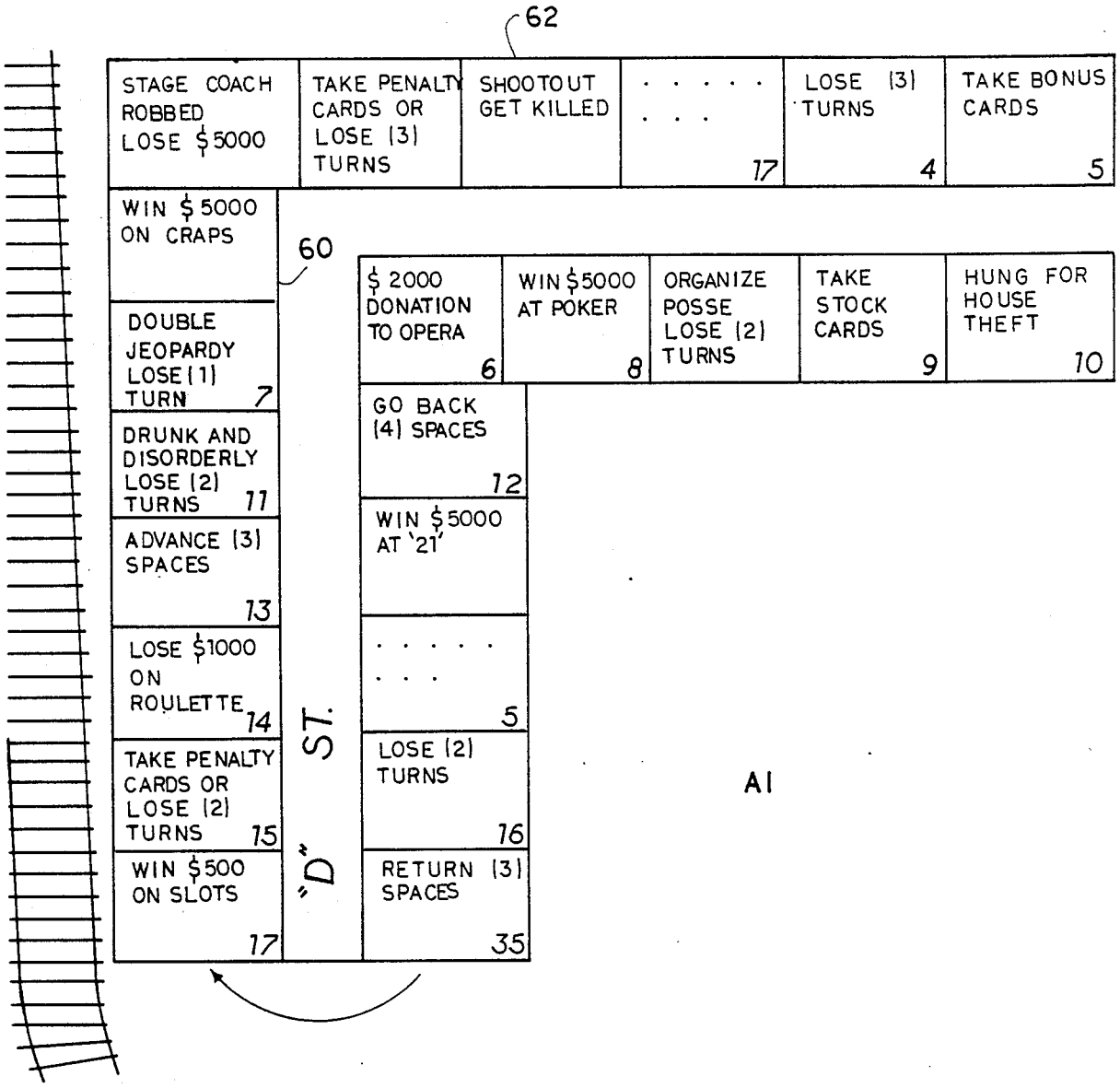
FIG. 2 through FIG. 11 depict all of the magnified viewed areas individually with the spaces drawn in actual detail. Legends are not duplicated but merely shown by like numbers in the corners of the spaces.
Figure 3:
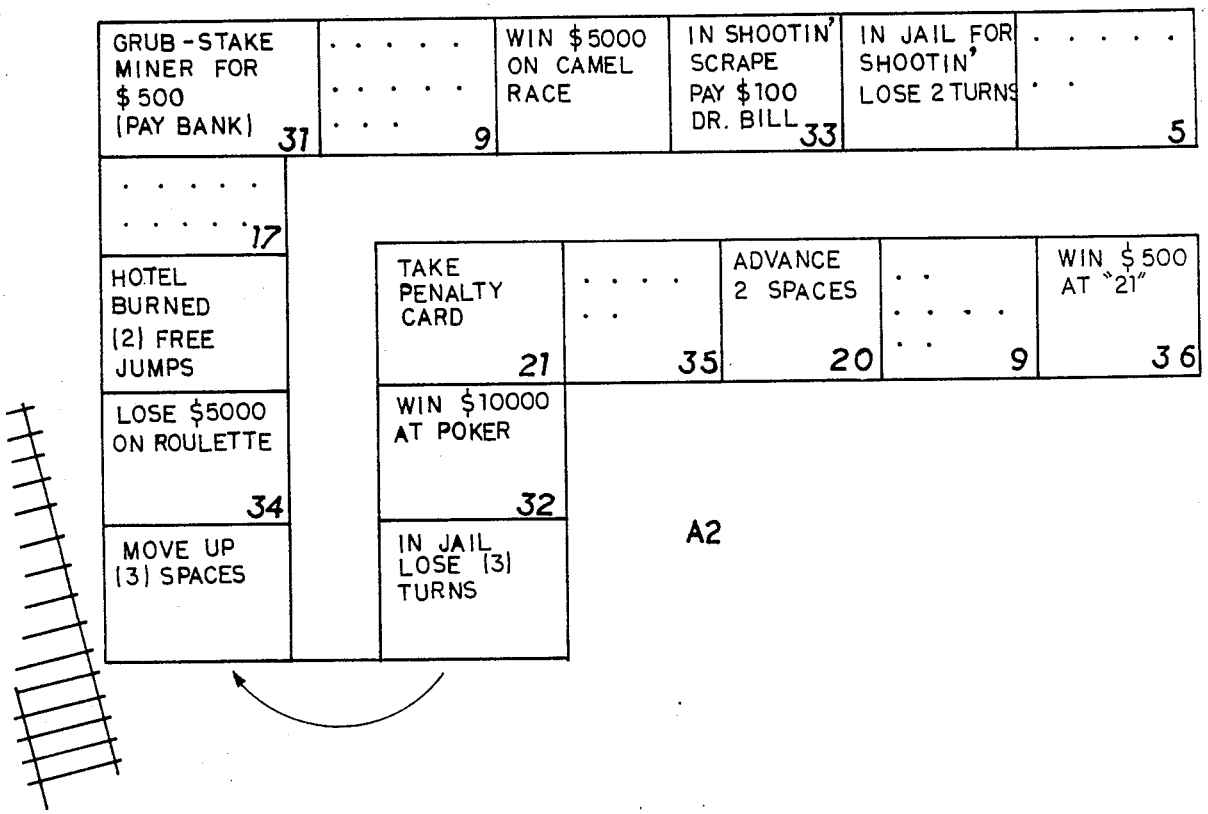
Figure 4:
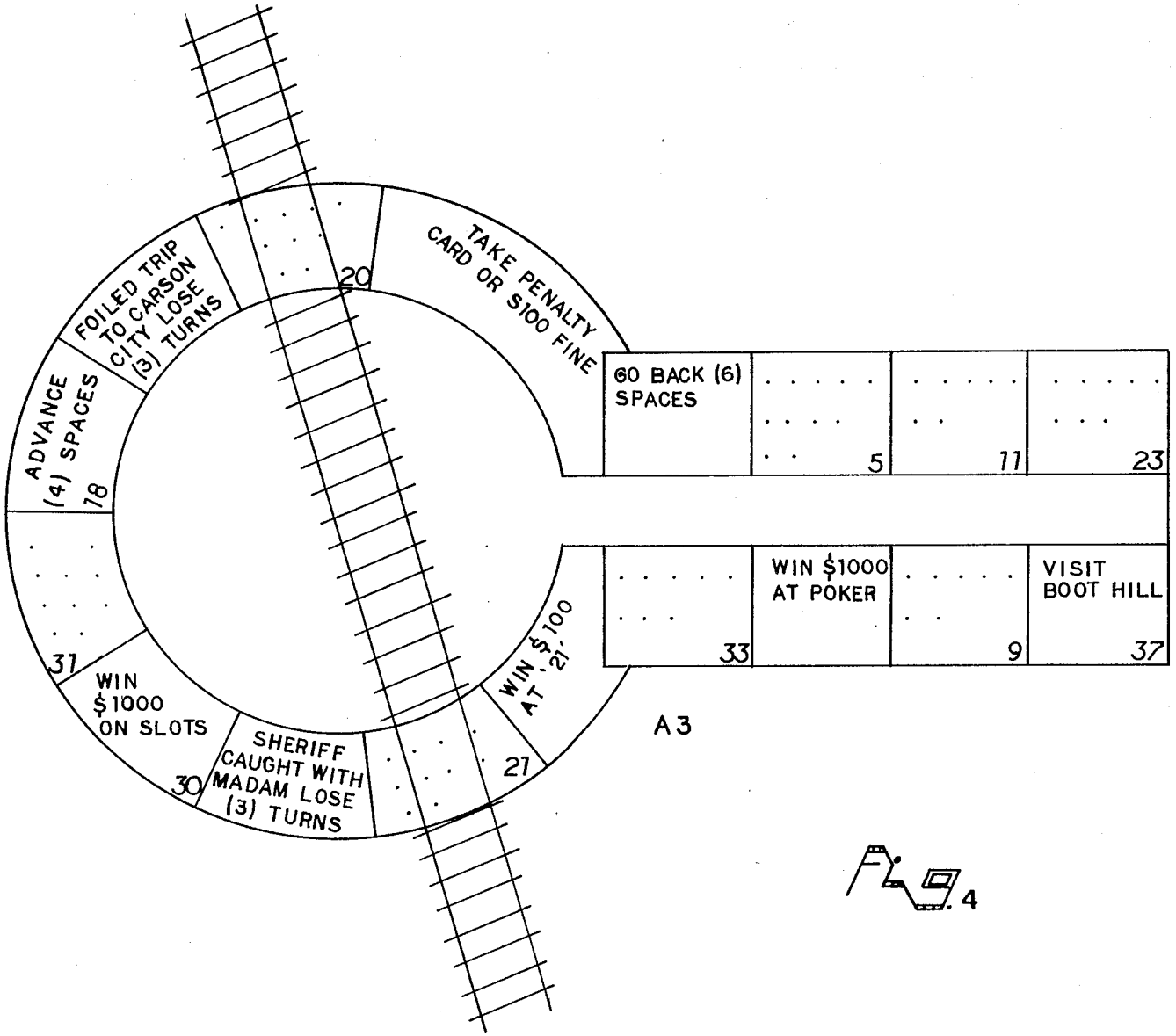
Figure 5:
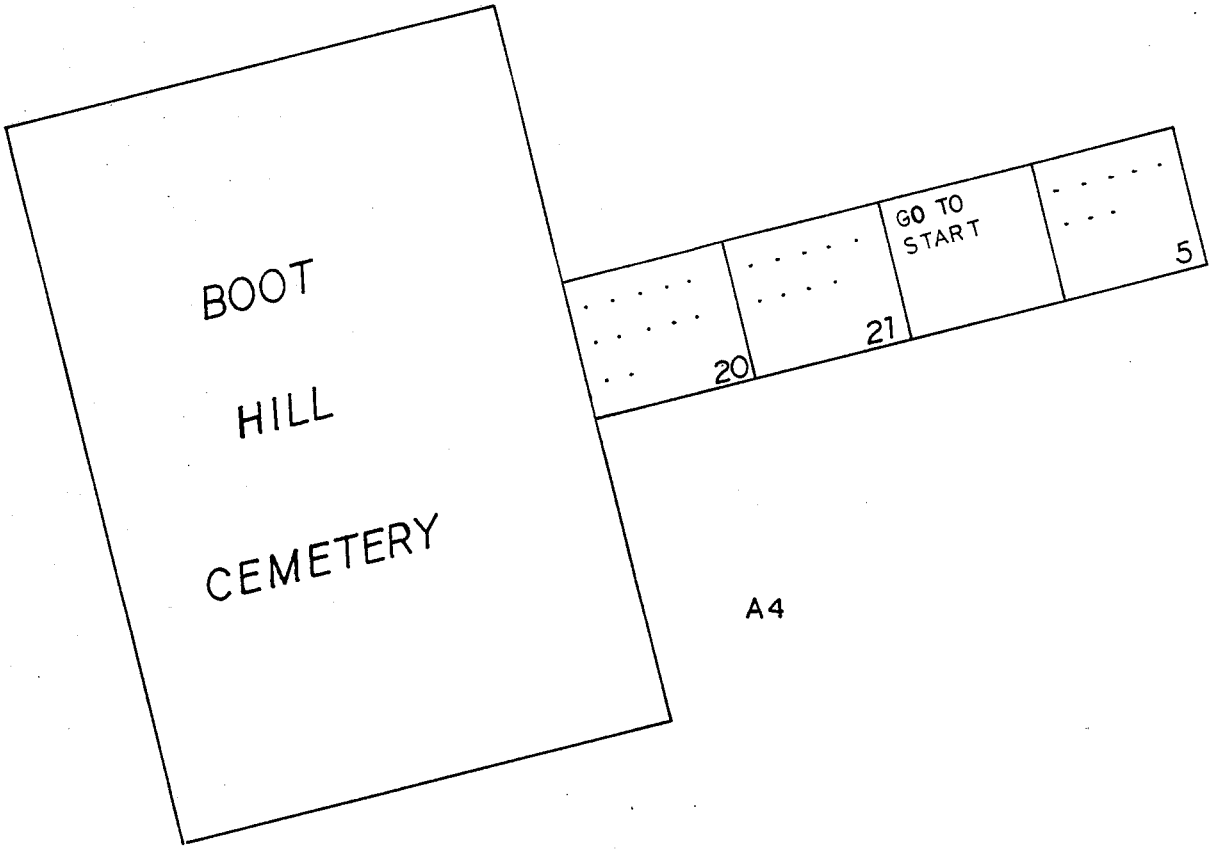

If a player lands on the Double Jeopardy 60 of FIG. 2, this player loses one turn and then continues to play. On the possibility of then landing on "shoot out-get killed" 62 of FIG. 2 the player is out of the game. On the contingency that a player gets past "shoot out-get killed" but then lands on "Return to Double Jeopardy" the player follows these last instructions. But upon moving again if he or she lands on the "shoot out-get killed" space he or she is not out of the game.

A player can only die once.

The game ends when each player has rolled the dice 48 once after the first person has crossed the finish line. Some players may not reach the finish line but the game is still over. The winner processes the most value of stock, bonus cards, and cash.

Typical penalty cards read as follows:

Lose $10,000 at Black Jack
Lose $10,000 at Roulette
Drunk and Fighting $100 fine
Drunk in Public $100 fine or lose one turn
Drunk and Hit Sheriff $500 fine
Drunk and Hit Sheriff $500 fine or lose three turns
Fighting lose one turn or $100 fine
Drunk and Disorderly $500 fine or lose three turns
Lose $2500 on craps
Lose $2500 at poker
Lose $2500 on camel races Typical bonus cards are drawn to various amounts of winning at Black Jack, the Slot Machine, Poker, Camel Races, Craps and Roulette. The denominations and quantitites of these cards are as follows:

7 cards: $10,000
6 cards: $5,000
8 cards: $2,500
11 cards: $500
8 cards: $100

Typical stock cards are given to various stock companies as follows: Kentuck Mine, Hull and Norcross, Yellow Jacket Mine, Crown Point, Ophir Mine, Comstock and Consolidated Virginia. The denominations and the quantity of cards are as follows:

4 cards: $10,000
2 cards: $7,500
3 cards: $5,000
4 cards: $2,000
4 cards: $1,500
7 cards: $1,000
6 cards: $750
2 cards: $500
4 cards: $200
4 cards: $150

We claim:

1. A method of playing a game comprising:

providing a game board with at least two segmented paths of sequential spaces with indicia giving directions including instructions and alternatively good and bad eventualities including gambling losses, gambling wins, criminal sentences, death, robbery, and visit to cemetery, with the first space being a start and with a single special space having inidicia indicating a cemetery and a path leading from said single special cemetery space to said start, and with the last space being a finish line;

providing bonus cards, stock cards and penalty cards;

providing a pair of dice, one of which is conventional and the other of which has inscribed "right" on two faces, "left" on two faces and "choice" on two faces;

designating two to eight players;

selecting by each player a representative token depicting a classical character of the old west;

providing a roulette wheel;

spinning the wheel by each player to determine playing order;

rolling the pair of dice by each player in that order to move the tokens to spaces on said path in accordance with the results of said rolling;

following the directions of said indicia on said spaces landed on by said tokens;

rolling said one conventional die by each player in the order determined by the wheel;

continuing to follow said directions;

acquiring stock cards, bonus cards and money upon landing on said good eventuality spaces;

taking a player out of the game by removing said player's token from the game board and returning said player's acquired stock cards, bonus cards and money to the bank upon said player's token landing on one of said death spaces;

finishing the game by all players having one turn after the first player crosses the finish line; and adding the sum of the value of bonus cards, stock cards and cash of each player;

whereby the player with the highest sum wins the game.

2. The method of claim 1 further wherein:

said at least two segmental paths are divided among right and left paths and said players roll said other die to designate these right and left paths or a choice by the player of either one.

* * * * *